United States Patent [19]

Yamasoe et al.

[11] Patent Number: 4,851,148

[45] **Date of Patent: * Jul. 25, 1989**

[54] METHOD OF CONTROLLING AN ALUMINUM SURFACE CLEANING COMPOSITION

[75] Inventors: Katsuyoshi Yamasoe, Chiba; Satoshi Ikeda; Kiyotada Yasuhara, both of Kanagawa, all of Japan

[73] Assignee: Amchem Products, Inc., Ambler, Pa.

[ * ] Notice: The portion of the term of this patent subsequent to Mar. 1, 2005 has been disclaimed.

[21] Appl. No.: 847,984

[22] Filed: Apr. 3, 1986

[30] Foreign Application Priority Data

Apr. 4, 1985 [JP] Japan ..... 60-72296

[51] Int. Cl.[4] ..... C11D 7/08

[52] U.S. Cl. ..... 252/142; 252/74.2; 252/146; 252/147; 134/3; 134/10; 134/18; 134/41; 148/23; 148/24; 156/665

[58] Field of Search ..... 252/142, 147, 146, 173, 252/79, 2; 134/3, 10, 41, 18; 156/665; 148/23, 24; 423/132, 556

[56] References Cited

U.S. PATENT DOCUMENTS 3,728,188 4/1973 Yarrington ..... 156/22
3,993,575 11/1976 Howanitz et al. ..... 252/544
4,435,223 3/1984 Dollman ..... 252/142

OTHER PUBLICATIONS

USSN 06/793,019, Yamasoe et al.

*Primary Examiner*—Paul Lieberman
*Assistant Examiner*—Hoa Van Le
*Attorney, Agent, or Firm*—Ernest G. Szoke; Wayne C. Jaeschke; Real J. Grandmaison

[57] ABSTRACT

In chromium-free aqueous acidic washing solutions for cleaning the surfaces of aluminum and aluminum-alloy particles, so as to remove therefrom smut and lubricating oil left on the surfaces thereof after metal forming operations, which solutions contain from 0.2 to 4 g/l ferric ion and sufficient sulfuric and/or nitric acid to impart a pH of 2 or less to the solution (and which optionally may also contain fluoride ions up to a concentration of 0.5 g/l) there is provided a method of controlling the effectiveness of the washing solution in which the ferric ion concentration therein is monitored, conveniently by the oxidation-reduction potential of the washing solution, as shown in FIG. 3, and is controlled within the desired limits by adding when appropriate suitable amounts of oxidant capable of oxidizing ferrous ions to ferric ions and, separately or in conjunction therewith, a replenisher containing a source of iron ions.

28 Claims, 2 Drawing Sheets

FIG. 1
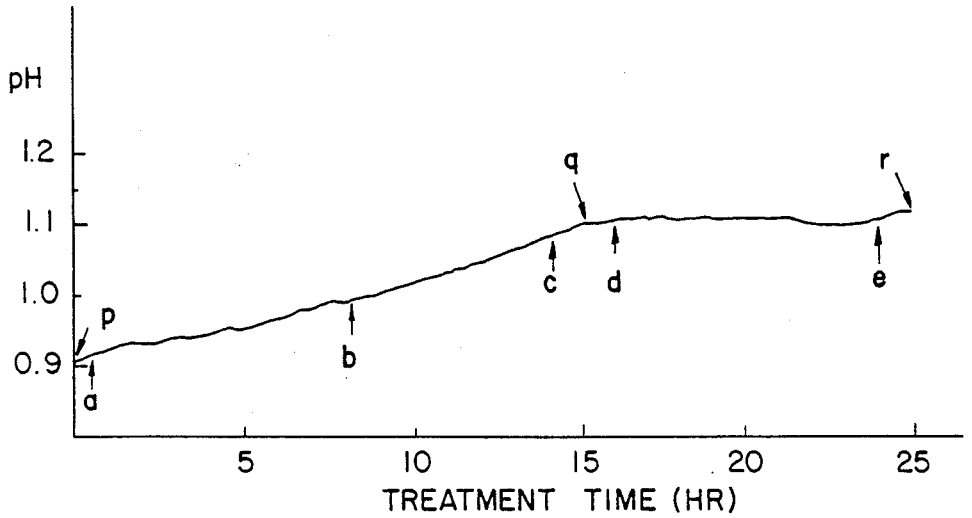
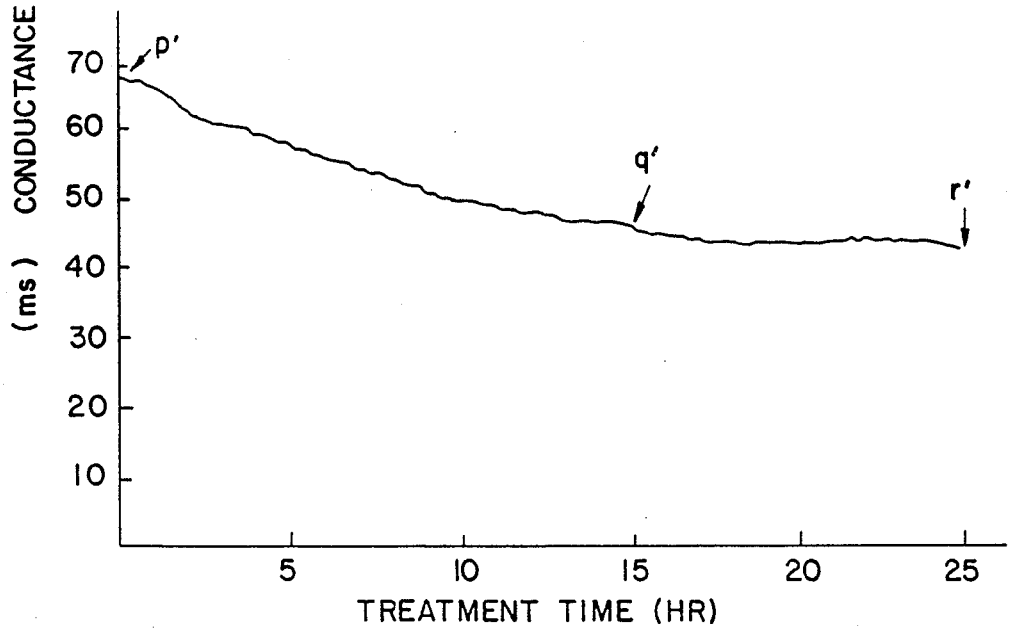
FIG. 2

METHOD OF CONTROLLING AN ALUMINUM SURFACE CLEANING COMPOSITION

BACKGROUND OF THE INVENTION

1. Field of the Invention

This invention relates to a method of controlling an aluminum surface cleaning composition. More specifically it is concerned with a method whereby it is possible, both easily and effectively, to monitor, control and thus maintain the effectiveness of an acidic cleaning solution used to remove lubricant oil and so-called "smut" (aluminum powder abraded from the surface) which adheres to the surface of aluminum articles after their manufacture by metal-forming operations.

2. Description of the Related Art

Aluminum articles such as beverage containers made of aluminum or aluminum alloys are customarily manufactured by a metal-forming operation called "drawing and ironing", often and conveniently referred to as "DI processing". In the course of this and similar metal-forming operations a lubricant oil is applied to the surface of the metal being deformed, and some abraded aluminum particles and other contaminants (usually referred to as "smut") adhere to the metal surface, especially to the inner walls of such beverage containers. For nearly all purposes, this smut must however be removed before subsequent manufacturing operations. Thus for instance such smut must be removed from the surfaces of aluminum beverage containers before they can be satisfactorily protected by chemical-conversion coating and/or paint coating techniques. It is therefore conventional to clean aluminum articles after metal-forming operations so as to remove smut from their surfaces, and this is normally done by means of a cleaning composition which slightly etches the metal, and thus imparts a satisfactory etched appearance to the aluminum article. In this surface cleaning operation the cleaning compositions employed are normally acidic.

Till now the acidic cleaning compositions used for smut-removal have generally-speaking been ones containing chromic acid, because the use of chromic acid avoids serious problems of corrosion of the treatment apparatus. The use of compositions based on chromic acid is however nowadays avoided due to the toxicity of the chromium ion. Consequently, it has been necessary to find substitute acidic cleaning compositions; and it has been proposed to use compositions based on hydrofluoric acid. For example, according to U.S. Pat. No. 3,728,188, a cleaning agent has been proposed which consists of an acidic aqueous solution containing 0.5–2.0 g/l fluoride ion, 5–21 g/l ferric ion, and 0.05–3.0 g/l thiourea, the pH of which is regulated to 0.1–1.8 with a strong mineral acid such as sulfuric acid, etc. With this cleaner, satisfactory surface cleaning is accomplished due to the fact that the large quantity of fluoride ions causes a rapid rate of etching the aluminum, while on the other hand, this etching is inhibited by the ferric ions.

The fluoride ion however also is toxic and it is therefore still necessary to take great care to prevent pollution of the operating environment and to treat waste liquid. Of course the problems arising from the use of hydrofluoric acid are mitigated if one can reduce the concentrations of fluoride ion used; but the general experience is that with low-fluoride compositions the performance of the cleaning compositions in smut-removal is impaired.

An acidic cleaning composition has recently been developed which solves these problems, and which can achieve satisfactory cleaning despite the fact that it contains little or no fluoride ion—see co-pending United States Patent Application Ser. No. 793,019, filed Oct. 30, 1985, and assigned to the same assignee as this Application. This recently-developed acidic cleansing composition is a chromium-ion-free acid aqueous solution containing 0.2–4 g/l of ferric ions, sufficient sulfuric acid and/or nitric acid to produce a pH of 2.0 or less, and optionally also up to 0.5 g/l fluoride ions.

In this chromium-free, low- or no-fluoride cleansing composition it is thought that the etching of the aluminum by the sulfuric acid or nitric acid is promoted by the ferric ions; this etch-promotion mechanism is assumed to be cathodic reaction $Fe(III)=e^{-}$—Fe (II). At all events, it has been found that in treatment baths using this new cleansing composition, the ferric ion content continuously and inevitably decreases. Hence it becomes necessary to replenish the treatment bath with a source of ferric ion in order to restore and maintain the ferric ion concentration in the treatment bath within the above-mentioned range. On the other hand, the above-mentioned cathodic reaction of the ferric ions produces ferrous ions, which tend to increase in the treatment bath. Such ferrous ions do not have an etch-promotion effect; and if they accumulate in large quantities they produce a precipitate which causes the treatment bath to become muddy and reduces its ability to perform the treatment. Furthermore, the increasing build-up of ferrous ions increases the tendency of iron to be dragged out of the treatment bath on the treated articles, and to be introduced thereby into the next subsequent chemical processing process stage, thus giving rise to an iron ion precipitate in that chemical-conversion coating stage which is detrimental to the quality of the article emergent from the final stages of the overall operations.

DESCRIPTION OF THE INVENTION

It has however now been found that the problems caused by the generation and build-up of ferrous ions in this kind of treatment bath can be overcome by introducing an oxidant into the treatment bath, that the depletion of the iron ions in the treatment bath caused by the drag-out on the treated articles can be compensated by replenishment, and that the ferric ion content of the treatment bath can be easily monitored and therefore controlled via the oxidation-reduction potential of the solution.

According to one aspect of this invention there is provided, in a process of cleansing aluminum articles by washing their surfaces with a chromium-free acidic aqueous cleaning solution containing 0.2–4 g/l ferric ions, optionally containing up to 0.5 g/l fluoride ions, and also containing sufficient sulfuric acid and/or nitric acid to impart a pH of 2.0 or less, the method of controlling the concentration of ferric ion therein in which the ferric ion concentration is monitored and when appropriate restored by suitable additions to the solution of an oxidant, either alone or in conjunction with replenishment by means of a water-soluble iron compound.

As just indicated the washing solution used in the process of this invention can be a low-fluoride solution containing up to 0.5 g/l fluoride ion; and in that event fluoride ion will normally be present in a concentration within the range of from 0.001 g/l to 0.5 g/l fluoride ions. Since however the washing solutions used in the process can operate satisfactorily in the absence of fluoride ions and since the presence of fluoride gives rise to operating and waste disposal and other environmental problems, it is normally a much preferred feature of the process to employ a fluoride-free washing solution.

The chromium-free, acidic aqueous cleaning solution used in the process of this invention, as already indicated above, is made up to contain 0.2–4 g/l ferric ions, and adjusted to a pH 2.0 or less with sulfuric acid and/or nitric acid, as described in the co-pending Application aforesaid. The disclosure of that co-pending Application is incorporated herein by cross-reference, but for convenience the salient details concerning the cleaning solution there disclosed and here employed can be summarized as follows.

Although any water-soluble ferric salt(s) could be used as a source of the ferric ions since the solution is to be chromium-free obviously the sources of ferric ion used must not also serve as sources of chromium ions. It should also be borne in mind that the chromium ions which must be excluded are not only hexavalent chromium ions proper (as provided by anhydrous chromic acid), but also trivalent chromium ions and complex salts containing such ions. Thus, water-soluble ferric salts such as $Fe_2(SO_4)_3$, $Fe(NO_3)_3$, $Fe(ClO_4)_3$ and others are very suitable sources of ferric ion for use in this invention—but chromium-containing salts such as $Fe_2(CrO_4)_3$ and $(NH_4)Fe(CrO_4)_2$ must not be used.

It is necessary to operate within the specified concentration range for ferric ion—since on the one hand if the ferric ion concentration in the washing solution bath is too low its accelerating effect upon the etching rate will be small and therefore satisfactory surface cleaning will not be achieved; yet on the other hand, if the ferric ion concentration is too high, the accelerating effect achieved will not be commensurate, and the etching effect due to fluoride ions in the presence of ferric ions will be diminished, so that again satisfactory surface cleaning will not be achieved.

It is also necessary to operate at specified pH of 2 or less. If the pH of the treatment bath is higher than 2, the rate of etching of the aluminum is greatly reduced, and satisfactory surface cleaning cannot be achieved.

There is no absolute need to set any lower limit for the pH value, but it has been found that below pH 0.6 no further improvement in the cleaning performance can be observed. There is no economic advantage in operating below pH 0.6, and the more strongly acidic the solution the greater is the problem of preventing corrosion of the treatment apparatus. The pH of the washing solution will therefore probably be in the range of 0.6–2.0.

The acids used for adjustment of the pH value of the washing solution must be sulfuric acid and/or nitric acid. The use of other mineral acids in the amounts needed for pH adjustment must be avoided, as they give rise to problems. For instance, when hydrochloric acid is used experience shows that pitting occurs on the aluminum surface in the presence of ferric ions, which is unacceptable—since such pitting not only impairs the appearance but also leads to edge-splitting during metal-working operations. The use of phosphoric acid leads to a great decrease in the etching rate, due to the aluminum ions which are eluted (dissolved and washed out). The presence of other mineral acids beside nitric or sulfuric therefore should be avoided as far as reasonably possible—but it will of course be understood that the presence of small amounts of other mineral acids within ranges which do not harm the surface cleaning can be tolerated.

Even with the use of nitric acid, there is a potential problem since when it is present there is a possibility that decomposition gases (e.g. NO and/or $N_2O_4$) might be evolved during the cleaning treatment; and the use of sulfuric acid for pH adjustment is therefore preferred.

The washing solutions employed (like those of the prior art) may advantageously also incorporate a surface active agent, usually at a concentration of 0.1–10 g/l, and preferably 0.5–4 g/l. The presence of such surface active agents in approximately these concentrations will improve the ability of the cleaning solution to remove the above-mentioned smut and lubricant oil. The surface active agents employed may be of the various non-ionic, cationic, anionic or amphoteric types, as in the prior art; and in general they can be used in admixture, but of course subject as always to the reservation that cationic and anionic agents cannot both simultaneously be present.

The washing solution may also desirably incorporate chelating agents, such as citric acid, oxalic acid or tartaric acid, which tend to accelerate the etching rate, and thus to improve the appearance of the treated article.

The cleaning process involves applying the washing solution to the surfaces of the aluminum article in any convenient manner, usually by an immersion or spray method, in accordance with standard practice. The cleaning solution may be applied within a wide range of temperatures, certainly between room temperature (say 20° C.) and 80° C., but preferably in the range of 50°–70° C. The period of treatment should be such as to achieve satisfactory cleaning, and will vary dependent upon the application temperature, the manner of application and the degree of contamination of the article to be treated—but generally-speaking the cleaning treatment should be carried out for a period in the range of 10–120 seconds.

The cleaning process as briefly described above has been more fully described and claimed in the aforesaid co-pending Application. It is the purpose of the present invention to cure certain problems which arise in performing that cleaning process, due to the depletion of ferric ion and the build-up of ferrous ion in the solution as it is used.

As already mentioned, when aluminum articles are processed through the washing solution, the ferric ion concentration therein decreases, and therefore must be restored so as to maintain the stipulated ferric ion concentration in the washing solution; but as already indicated, when aluminum articles are processed through the cleaning solution it is also found that there is a build-up in the concentration of ferrous ions in the washing solution, which also causes a problem.

These problems are overcome according to the present invention by a method in which the ferric ion concentration in the washing solution is monitored, and when appropriate is controlled primarily by adding an oxidant which serves to oxidize the unwanted ferrous ions, and thus to regenerate therefrom the desired ferric ions—and in this way goes far to re-establish and maintain the desired ferric ion concentration level.

In principle, any of the conventional oxidizing agents may be used as the oxidant for this purpose, but of course one should avoid oxidants which have some other, adverse effect upon either the aluminum surface or the environment. For environmental reasons chromatetype oxidants of course cannot be used in the chromium-free solutions of this invention; and permanganate-type oxidants are not recommended and should preferably be avoided, since they tend to react with the aluminum substrate and thus to produce an unwanted film thereon. So far as has been ascertained it is however possible to use all other oxidants conventionally employed in the metal-pretreatment art, and certainly suitable oxidants include for instance hydrogen peroxide, nitrite-type oxidants (e.g. sodium nitrite), peroxosulfate-type oxidants (e.g. sodium peroxosulfate), metavanadate-type oxidants (e.g. ammonium metavanadate), cerium-compound-type oxidants (e.g. cerium ammonium sulfate) and others.

It will however be appreciated that even when the method of this invention is fully effective to oxidize all of the ferrous ions in the treatment solution to ferric ions by means of the above-mentioned oxidants, nevertheless the total concentration of iron ions in the solution will continually decrease due to their removal from the treatment solution by drag-out on the surfaces of the articles processed through the washing solution. The mere addition of oxidant is therefore not alone sufficient to restore and maintain the desired ferric ion concentration indefinitely. In the method of this invention, it will therefore intermittently be necessary to supplement the regneration of ferric ions (by means of the oxidant) by replenishing the iron concentration in the treatment solution with suitable, water-soluble iron salts, to an extent commensurate with the decrease in iron ion concentration therein. The decrease in overall iron concentration is due primarily to drag-out of the ferric ions on articles being processed through the treatment solution, but if ferrous ions are allowed to build up in the treatment solution then of course these too will be removed by drag-out and lost.

When intermittently it is necessary to replenish the iron content of the solution, this is best done by supplying the desired ferric ion in the form of suitable water-soluble ferric salts, such as ferric sulfate or ferric nitrate. It is however also possible, and within the scope of this invention, to replace the iron deficiency (either wholly or partly) by supplying suitable water-soluble ferrous salts, such as $FeSO_4$ or $Fe(NO_3)_2$, relying in that case upon the oxidant (either upon oxidant already present in the solution, or better upon extra oxidant simultaneously added for that purpose) to oxidize the ferrous ion and thus generate ferric ion therefrom.

Thus, looking at the matter overall, the treatment solution will need to be supplied, either continuously or intermittently (and perhaps then at different intervals), with both oxidant and iron salt; and these may be supplied either separately and then perhaps at different times or perhaps simultaneously) or in conjunction—while the iron salt may be supplied either as a ferrous salt (perhaps in conjunction with extra oxidant) or preferably as a ferric salt.

The replenishment techniques described above will serve to restore and maintain the desired ferric ion concentration in the washing solution (and to keep it virtually free of the undesired ferrous ion) but of course only if replenishment is undertaken when and to the extent that it is appropriate, which must be ascertained by monitoring the ferric ion concentration in the washing solution as it is used.

Fortunately, it is easily possible to monitor the ferric ion concentration in the washing solution, using techniques known per se in solutions of this general type. It may for instance be done, very conveniently and accurately, by measurement of the oxidation-reduction potential of the solution. Thus for instance, as is described in more detail hereafter in Example 2, when using hydrogen peroxide as the oxidant and employing a standard silver/silver chloride reference electrode with an oxidation-reduction potential of 550–700 mV (which happens to be almost the same as that of the washing solution as initially made up) it is easily possible to feed hydrogen peroxide to the cleaning solution as it is used in such continuous or intermittent amounts as are appropriate to restore and maintain the oxidation-reduction potential of the solution at approximately the standard 550–700 mV value of the reference electrode.

It will of course be understood that when using this kind of arrangement for monitoring and controlling the ferric ion concentration in the washing solution it will be necessary to choose a standard reference electrode which exhibits an oxidation-reduction potential closely adjacent that of the washing solution as initially made up, which naturally will be dependent upon the total ion concentration in the cleaning solution and the kind of oxidant to be employed. This however should be within the normal competence of those involved in setting up such a monitoring and controlling arrangement.

The pH of the treatment solution may be monitored and controlled by measuring the conductance, in a manner known per se for pH control. It has been found that in the washing solutions of the invention the desired pH range will correspond approximately to conductances in the range of 20–80 ms/cm.

Because both the necessary parameters (namely ferric ion concentration and pH value) can be measured and controlled as described above, it is a valuable consequence of the control method of this invention that the cleaning process can readily be automated thus simultaneously making the process easier to control and also more efficient.

DESCRIPTION OF THE ACTUAL EXAMPLES

In order that the invention may be well understood it will now be described in more detail, but only by way of illustration, in the following actual examples:

EXAMPLE 1

A large number of semi-manufactured, lidless beverage containers, so-called "can blanks", were manufactured by the known DI-process from the conventional alloy sheet. The can-blanks thus made had a diameter of 6.6 cm and an internal volume of 350 ml. These can-blanks were then passed through a continuous sequence of washing and conversion-coating operations (essentially conventional in nature, except as indicated below) as follows:

SEQUENCE OF WASHING AND CONVERSION-COATING STAGES (A) Water-prewash with water (30°±10° C., 5 seconds, spray pressure 1.0 kg/cm$^2$)
(B) Dilute-prewashing (60°±4° C., 20 seconds, spray pressure 1.0 kg/cm$^2$)
(C) Main washing (70°±2° C., 1 minute, spray pressure 3.0 kg/cm$^2$)
(D) Intermediate water-wash (25°–35° C., 30 seconds, spray pressure 0.5 kg/cm$^2$)
(E) Conversion-coating (35°–40° C., 30 second, spray pressure 0.6 kg/cm$^2$)

(F) Water after-wash (25°–35° C., 30 seconds, spray pressure 0.5 kg/cm$^2$)
(G) Deionized water after-rinse (20°–30° C., 20 seconds, spray pressure 0.5 kg/cm$^2$)
(H) Drying (210°±10° C., 2 minutes, air-drying)

Each can-blank underwent this sequence of washing and conversion-coating stages over a period of approximately 5 to 10 minutes; but the whole operation was carried out at the rate of 600 cans per minute for 5 hours per day (thus 180,000 cans per day) for a period of 5 days.

The water-prewash (A), the intermediate water-wash (D), the water after-wash (F) and the deionized-water after-rinse (G), as well as the conversion-coating (E) and drying (H) stages were all conventional. The dilute pre-wash (B) was also in a sense conventional, in that it was performed (as is conventional) with a much diluted version of the main washing solution—but that main washing solution (either undiluted or diluted) was not itself conventional, being made up in accordance with the co-pending Application aforesaid.

Specifically, the main washing solution employed in stage (C) had the following composition:

| | |
|---|---|
| Ferric ions | 1.25 g/l |
| Sulfate ions | 12.50 g/l |
| Nitrate ions | 1.50 g/l |
| Non-ionic surface active agent | 1.75 g/l |
| pH | 0.92 |

The dilute pre-washing solution employed in stage (D) was made up by diluting the main washing solution to an extent of approximately 10%.

The conversion-coating solution employed in stage (E) was a standard commercially-available product (sold under the name "Alodine 4040" by Nippon Paint Co. Ltd., Osaka, Japan—used at 2% v/v dilution) which is not directly relevant to the present invention and therefore will not be further described here.

OPERATING PROCEDURE IN MAIN WASHING STAGE (C)

The main washing operation was performed by passing the can-blanks through a bath containing 2000 liters of the above-described solution. Throughout the whole 5-day period the bath was monitored and controlled by the method of this invention so as to maintain it in operating condition by adding both an oxidant and a replenisher. The oxidant employed was hydrogen peroxide ($H_2O_2$–100%) which throughout the whole period was added at a rate of 10 g/minute. The replenisher employed contained water-soluble salts supplying ferric (iron III) ions, sulfate ions and nitrate ions, as well as a non-ionic surface active agent—and was added at different rates at different times, as will be described below.

The course of the main washing operation was monitored and recorded, and the results obtained appear from the accompanying drawings, in which:

FIG. 1 is a graph showing changes in the pH of the main washing solution over the whole five-day (5-hours per day) period;

FIG. 2 is a graph similarly showing corresponding changes in conductance over the same 25-hour period.

Figure 3:
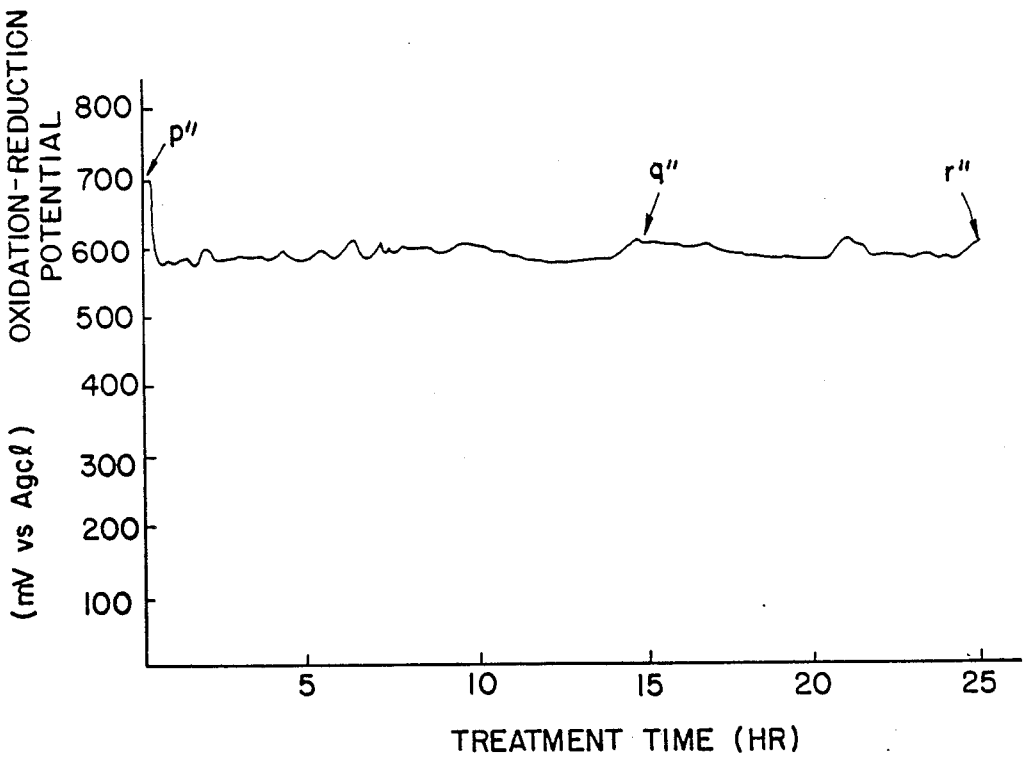
FIG. 3 is a graph showing changes in oxidationreduction potential over the same period.

During the first 3 days (i.e. the first 15 hours of actual processing time) the bath was fed with a replenisher at such a rate as to supply the necessary ingredients to the washing solution at the following rates:

| | |
|---|---|
| Ferric ions | 2.9 g/min |
| Sulfate ions | 28.8 g/min |
| Nitrate ions | 3.6 g/min |
| Non-ionic surface active agent | 4.8 g/min |

Over this initial period, the changes which occurred in the washing solution appear from the graphs of FIGS. 1 to 3, as follows:

the variations in the pH of the solution are shown in section p-q of FIG. 1;

the variations in the conductance of the solution are shown in section p'-q' of FIG. 2; and the variations in the oxidation-reduction potential (silver-silver chloride electrode potential standard) are shown in section p''-q'' of FIG. 3.

At the end of the initial 3-day (15 hour) period, the quantity of aluminum dissolved in the washing solution in the 'aged' bath was measured; and it was found to be approximately 0.8 g/l. Reference to FIG. 1 also showed that over the same period the pH of the washing solution had risen steadily from its starting value of about 0.9 to about 1.1. In order to stabilize the pH value it was therefore decided to increase the rate at which the bath was fed with replenisher.

Accordingly, as from the 4th day onwards (i.e. during the last 10-hour period) the bath was fed with the replenisher at such a rate as to supply the necessary ingredients to the bath at the following rates:

| | |
|---|---|
| Ferric ions | 5.8 g/min |
| Sulfate ions | 57.6 g/min |
| Nitrate ions | 7.2 g/min |
| Nonionic surface active agent | 9.6 g/min |

At the same time, in order to avoid bath overflow, automatic drainage from the bath was commenced, at a rate of 2.5 l/minute.

Over this terminal period, the changes which occurred in the washing solution appear from the graphs of FIGS. 1–3 as follows:

the variations in the pH of the solution are shown in section q-r of FIG. 1;

the variations in the conductance of the solution are shown in section q'-r' of FIG. 2; and the variations in the oxidation-reduction potential of the solution are shown in section q''-r'' of FIG. 3.

In addition, the ferric ion concentration in the washing solution was known at the very beginning, and was determined after 3 days (15 hours) and at the very end of the operation—thus at points indicated p'', q'' and r'' in FIG. 3. The ferric ion concentration at the outset was 1.25 g/l and the ferric ion concentrations in the washing solution as determined at points q'' and r'' of FIG. 3 were respectively 1.15 g/l and 1.20 g/l.

OBSERVED RESULTS

The can-blanks emerging from the main washing stage were sampled at the points of time shown by arrows a, b, c, d and e in FIG. 1; and the sample can-blanks were examined and tested.

It was found that at all times they displayed an external appearance which can be described as whitish, and somewhat like pear flesh; that almost no adhesion of smut could be observed; and that no adhesion of residual oil upon the can-blanks could be detected. The washing effect of the treatment was therefore evaluated as good, no matter how far the washing solution had aged.

At the same points of time samples were also taken from the can-blanks emerging from the final drying stage. The dried can-blanks were examined and tested, and in every case (thus no matter how far the washing solution had aged) it was found that the conversion coating formed on the can-blanks was a good one; and that good results were secured when the can bottoms were subject to tests to determine whether they would turn black with boiling water.

The conclusion drawn from the extensive testing procedure was that despite the aging of the main washing solution as aluminum accumulated therein it was possible to exert a satisfactory control over its performance using the method of this invention.

EXAMPLE 2

EFFECT OF VARIOUS OXIDANTS

In order to evaluate the effects of various kinds of oxidants on an aged bath, a main washing solution was made up which contained 1.2 g/l ferric ions at the outset; and using this as the main washing solution (and a 10% dilution thereof as the prewash solution) the whole operation was carried out in the same manner as in Example 1.

As the operation progressed, the continuous throughput of the aluminum can-blanks caused the ferric ion concentration in the bath to decrease and the ferrous ion concentration therein to increase, while the amount of etching of the treated article decreased.

The aged washing solutions thus formed were then restored by means of added oxidant and replenisher. The amounts of oxidant and replenisher added were in each case designed to restore the ferric ion concentration in the aged solution to the same value as that in the solution at the outset.

The nature of the oxidants used and the results obtained using them appear from Table 1 below:

TABLE 1

Table 1A - Composition of Solution and Oxidant used.

| Test | Iron content of initial washing solution | Iron content of aged washing solution | Oxidant employed to regenerate Fe(III) |
|---|---|---|---|
| 1 | Fe(III) 1.2 g/l<br>Fe(II) 0 g/l | — | — |
| 2 | — | Fe(III) 0.2 g/l<br>Fe(II) 1.0 g/l | $H_2O_2$ |
| 3 | — | Fe(III) 0.2 g/l<br>Fe(II) 1.0 g/l | $NH_4VO_3$ |
| 4 | — | Fe(III) 0.2 g/l<br>Fe(II) 1.0 g/l | $NaNO_2$ |
| 5 | — | Fe(III) 0.2 g/l<br>Fe(II) 1.0 g/l | $Na_2S_2O_8$ |
| 6 | | Fe(III) 0.2 g/l<br>Fe(II) 1.0 g/l | $(NH_4)_4Ce(SO_4)_4$ |

hz,1/32

Table 1B - Observed Results

| Test | Oxidation-reduction potential before and after adding oxidant (mV) | | Amount of etching before and after adding oxidant ($mg/m^2$) | | Comparison of aluminum can appearance at outset and after adding oxidant |
|---|---|---|---|---|---|
| | before | after | before | after | |
| 1 | 685 | — | 110 | — | no difference |
| 2 | 430 | 640 | 45 | 111 | no difference |
| 3 | 430 | 750 | 45 | 93 | no difference |
| 4 | 430 | 675 | 45 | 83 | no difference |
| 5 | 430 | 1113 | 45 | 112 | no difference |
| 6 | 430 | 1218 | 45 | 5 | no difference |

What is claimed is:

1. In a process for cleaning an aluminum surface comprising the steps of a. contacting said aluminum surface with a chromium-free acidic aqueous cleaning solution consisting of from about 0.2 to about 4 g/l of ferric ions, a quantity of sulfuric and/or nitric acid to provide a pH for the cleaning solution of 2.0 or less, and up to 0.5 g/l of fluoride ions; the improvement comprising:

b. monitoring the ferric ion concentration in the cleaning solution;

c. when the ferric ion concentration falls below a predetermined level, restoring the ferric ion concentration to at least said predetermined level by adding to the cleaning solution an oxidant compatible with a clean aluminum surface in an amount sufficient to oxidize ferrous ions present in the cleaning solution to ferric ions; and d. replenishing the iron ion concentration in the cleaning solution as needed by the addition thereto of at least one water-soluble iron compound.

2. In a process according to claim 1 wherein the cleaning solution is substantially fluoride-free.

3. In a process according to claim 1 wherein in step b. the ferric ion concentration is monitored by a measurement of the oxidation-reduction potential of the cleaning solution.

4. In a process according to claim 1 wherein in step c. the oxidant is one or more of a peroxide, nitrite, peroxosulfate, metavanadate or cerium compound.

5. In a process according to claim 4 wherein the oxidant is one or more of hydrogen peroxide, sodium nitrite, sodium peroxosulfate, ammonium metavanadate, and cerium ammonium sulfate.

6. In a process according to claim 1 wherein in step d. the water-soluble iron compound is selected from ferric sulfate and ferric nitrate.

7. In a process according to claim 1 wherein in step a. the ferric ions are present in the form of one or more of ferric sulfate, ferric nitrate, and ferric chlorate.

8. In a process according to claim 1 wherein in step a. the cleaning solution also contains from about 0.5 to about 4 g/l of a surface active agent.

9. In a process according to claim 1 wherein in step a. the cleaning solution also contains a chelating agent.

10. In a process according to claim 9 wherein the chelating agent is one or more of citric acid, oxalic acid, and tartaric acid.

11. In a process according to claim 1 wherein in step a. said contacting is carried out by immersion or spray at a temperature within the range of about 20° C. to about 80° C.

12. In a process according to claim 1 wherein in step c. the predetermined level of ferric ion is a quantity within the range of from about 0.2 to about 4 g/l.

13. In a process according to claim 1 including monitoring the pH of the solution and when the pH is greater than about 2.0, a quantity of sulfuric and/or nitric acid is added to the bath to lower the pH to between about 0.6 and about 2.0.

14. In a process according to claim 1 wherein in step d. the water-soluble iron compound is a ferrous compound which is added together with sufficient oxidant to oxidize the ferrous ions to ferric ions.

15. In a process according to claim 1 including monitoring the pH of the solution and when the pH is greater than a predeterminal pH level below 2.0, a quantity of sulfuric and/or nitric acid is added to the bath to lower the pH to between about 0.6 and about 2.0.

16. In a process for cleaning an aluminum surface comprising the steps of a. contacting said aluminum surface with a chromium-free acidic aqueous cleaning solution consisting of from about 0.2 to about 4 g/l of ferric ions, a quantity of sulfuric and/or nitric acid to provide a pH for the cleaning solution of 2.0 or less, and up to 0.5 g/l of fluoride ions; the improvement comprising:

b. maintaining in the cleaning solution an oxidant compatible with a clean aluminum surface in an amount sufficient to oxidize ferrous ions present in the cleaning solution to ferric ions; and c. replenishing the iron ion concentration in the cleaning solution as needed by the addition thereto of at least one water-soluble iron compound.

17. In a process according to claim 16 wherein the cleaning solution is substantially fluoride-free.

18. In a process according to claim 16 wherein in step b. the oxidant is one or more of a peroxide, nitrite, peroxosulfate, metavanadate or cerium compound.

19. In a process according to claim 18 wherein the oxidant is one or more of hydrogen peroxide, sodium nitrite, sodium peroxosulfate, ammonium metavanadate, and cerium ammonium sulfate.

20. In a process according to claim 16 wherein in step c. the water-soluble iron compound is selected from ferric sulfate and ferric nitrate.

21. In a process according to claim 16 wherein in step a. the ferric ions are present in the form of one or more of ferric sulfate, ferric nitrate, and ferric chlorate.

22. In a process according to claim 16 wherein in step a. the cleaning solution also contains from about 0.5 to about 4 g/l of a surface active agent.

23. In a process according to claim 16 wherein in step a. the cleaning solution also contains a chelating agent.

24. In a process according to claim 23 wherein the chelating agent is one or more of citric acid, oxalic acid, and tartaric acid.

25. In a process according to claim 16 wherein in step a. said contacting is carried out by immersion or spray at a temperature within the range of about 20° C. to about 80° C.

26. In a process according to claim 16 including monitoring the pH of the solution and when the pH is greater than about 2.0, a quantity of sulfuric acid/or nitric acid is added to the bath to lower the pH to between about 0.6 and about 2.0.

27. In a process according to claim 16 wherein in step c. the water-soluble iron compound is a ferrous compound which is added together with sufficient oxidant to oxidize the ferrous ions to ferric ions.

28. In a process according to claim 16 including monitoring the pH of the solution and when the pH is greater than a predetermined pH level below 2.0, a quantity of sulfuric and/or nitric acid is added to the bath to lower the pH to between about 0.6 and about 2.0.

* * * * *